US006796057B2

(12) United States Patent
Davis

(10) Patent No.: US 6,796,057 B2
(45) Date of Patent: Sep. 28, 2004

(54) GROWTH INDICATOR FOR CHILDREN'S SHOES

(76) Inventor: Howard F. Davis, 45 W. 132nd St., New York, NY (US) 10037

( * ) Notice: Subject to any disclaimer, the term of this patent is extended or adjusted under 35 U.S.C. 154(b) by 133 days.

(21) Appl. No.: 10/164,527

(22) Filed: Jun. 7, 2002

(65) Prior Publication Data

US 2002/0184790 A1 Dec. 12, 2002

Related U.S. Application Data

(60) Provisional application No. 60/296,643, filed on Jun. 7, 2001, and provisional application No. 60/323,154, filed on Sep. 18, 2002.

(51) Int. Cl.[7] ..... A43B 3/26
(52) U.S. Cl. ..... 36/97; 36/112
(58) Field of Search ..... 36/112, 100, 101, 36/97

(56) References Cited

U.S. PATENT DOCUMENTS 797,966 A * 8/1905 Lange et al. ..... 36/8.2
1,821,051 A * 9/1931 Brown ..... 36/8.4
2,523,449 A * 9/1950 Rosenzweig ..... 36/97
4,120,103 A * 10/1978 Colby ..... 36/97
5,659,980 A * 8/1997 Lin ..... 36/112

FOREIGN PATENT DOCUMENTS

EP 446990 * 9/1991
FR 2619490 * 2/1989

* cited by examiner

*Primary Examiner*—M. D. Patterson
(74) *Attorney, Agent, or Firm*—Cohen, Pontani, Lieberman & Pavane

(57) ABSTRACT

A shoe includes a shoe upper sized for receiving a range of foot sizes from a minimum foot size to a maximum foot size. A growth indicator is connected with the shoe upper and includes an indicator for indicating when the foot of a wearer is equal to or greater than the maximum size of the range of foot sizes.

27 Claims, 8 Drawing Sheets

GROWTH INDICATOR FOR CHILDREN'S SHOES

RELATED APPLICATION

The present application claims the benefit of the filing date of co-pending provisional application Nos. 60/296,643, filed on Jun. 7, 2001, and 60/323,154, filed on Sep. 18, 2002, the entire contents of which are incorporated herein by reference.

BACKGROUND OF THE INVENTION

1. Field of the Invention

The present invention relates to a device in a shoe for indicating a size of the wearer's foot relative to the shoe size. More specifically, the present invention relates to a device for indicating when a child's foot has outgrown a shoe.

2. Description of the Related Art

Shoes are typically designed to fit a specific size foot and may be made of an expansible or stretchable material which snugly, but comfortably holds the wearer's foot. However, if a wearer, such as a child wearer, has an increasing foot size the shoes are not likely to fit the wearer's foot comfortably for very long. To prevent this, the shoe can be purchased in a size slightly larger than an optimal size so that the child's foot grows into the shoe. However, it is sometimes difficult to determine when the child has outgrown the shoe until the child's foot is too large such that the shoe causes discomfort.

To extend the time period that a shoe may be worn by a child, a shoe may be manufactured with an expandable liner as disclosed in U.S. Pat. No. 6,279,251 (the '251 reference) or an expandable upper as disclosed in U.S. Pat. No. 6,374,515 (the '515 reference). According to the teaching of these references, the shoe upper or a liner in the shoe expands so that the shoe fits the wearer's foot as the wearer's foot grows through a range of sizes spanning at least one shoe size. As the wearer's foot grows, it is desirable to know when the upper end of the range is reached. The '251 reference teaches that a transparent window may be installed in the shoe upper so that the extension of the wearer's toes into the toe area of the shoe can be viewed. However, the transparent window may interfere with the style of the shoe.

Furthermore, the transparent window taught by the '271 reference would not provide its intended function in the shoe disclosed in the '515 reference in which the shoe upper itself expands because the toe is always at the same location relative to the front of the shoe.

A test shoe is disclosed in U.S. Pat. No. 1,752,254 which includes a shoe upper having a transparent section which allows a wearer's foot to be viewed while the shoe is being worn and thereby indicate whether the shoe is too large or too small. However, a problem with this test shoe is that the wearer's foot is only tested when the shoe is initially bought. Since a child's foot is continuously growing, the actual fit of the shoe will change shortly after the shoe is bought. Accordingly, the test shoe and other devices used to determine an actual fit of a shoe at the point of sale fail to aid in determining when a shoe is outgrown.

Another device which is disclosed in U.S. Pat. No. 2,464,571 teaches the use of a marking means which is placed in the shoe either on the sole or on the upper. After the marking means is placed in the shoe, the wearer places his foot in the shoe. A marking medium is applied to the wearer's foot as the wearer's foot is slipped into the shoe. The marking medium leaves an indication on the marking means which can be used to assess the size of the wearer's foot relative to the shoe. However, this device requires a cumbersome measuring process in which a marking means must be inserted in the shoe each time the size of the foot is to be measured.

SUMMARY OF THE INVENTION

It is an object of the present invention to provide a shoe having a device for indicating a size of a wearer's foot to thereby indicate whether the wearer has outgrown or will soon outgrow the shoe.

A shoe according to the present invention includes a shoe upper defining a heel portion and a toe portion for receiving a wearer's foot within a range of foot sizes including a minimum foot size to a maximum foot size. A growth indicator having an indication is connected to the shoe upper and the state of the indication changes when a size of a wearer's foot received in the shoe upper is at least as large as the maximum foot size of the allowable range.

The growth indicator includes first and second indicator parts arranged on the shoe upper. The first indicator part is movable relative to the second indicator part in response to a size of a wearer's foot received in the shoe upper. The first indicator part may include an indicator strip having a first end connected to the shoe upper proximate either the heel portion or the toe portion of said shoe upper. A second end of the indicator strip extends toward the other of the heel portion or the toe portion.

In a shoe having an expandable upper, the upper expands as the wearer's foot is inserted while the indicator strip stays in one position. In one embodiment of the present invention, the upper is fitted with a window which moves along the length of the indicator strip as the upper expands. The indicator strip includes a marking which is viewable through the window when the upper has expanded to a position corresponding to the maximum foot size, thus indicating that the shoe is outgrown.

In another embodiment, a sensor may be arranged to sense the extent of expansion of the upper. In this embodiment, an indicating device such as a light is connected to the sensor and changes state when the sensor senses that the upper has expanded to a position corresponding to the maximum foot size.

In yet another embodiment, the shoe includes an expandable liner. An indicator strip may be connected to the front of the liner so that is moves with the front of the liner as the liner expands. The indicator strip may be arranged to move along a window in the shoe upper so that a marking on the indicator strip is viewed when the liner expands to a position corresponding to the maximum foot size. Alternatively, a sensor may be connected to sense the expansion of the liner either via the movement of the strip or by detecting the movement of the liner directly.

In yet a further embodiment, a pressure sensor may be arranged proximate the toe portion of the shoe upper for sensing pressure exerted thereon by the wearer's foot received in the shoe upper. An indicator attached to the pressure sensor is connected for changing its state when the pressure sensor senses a pressure corresponding to that of a maximum foot size.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
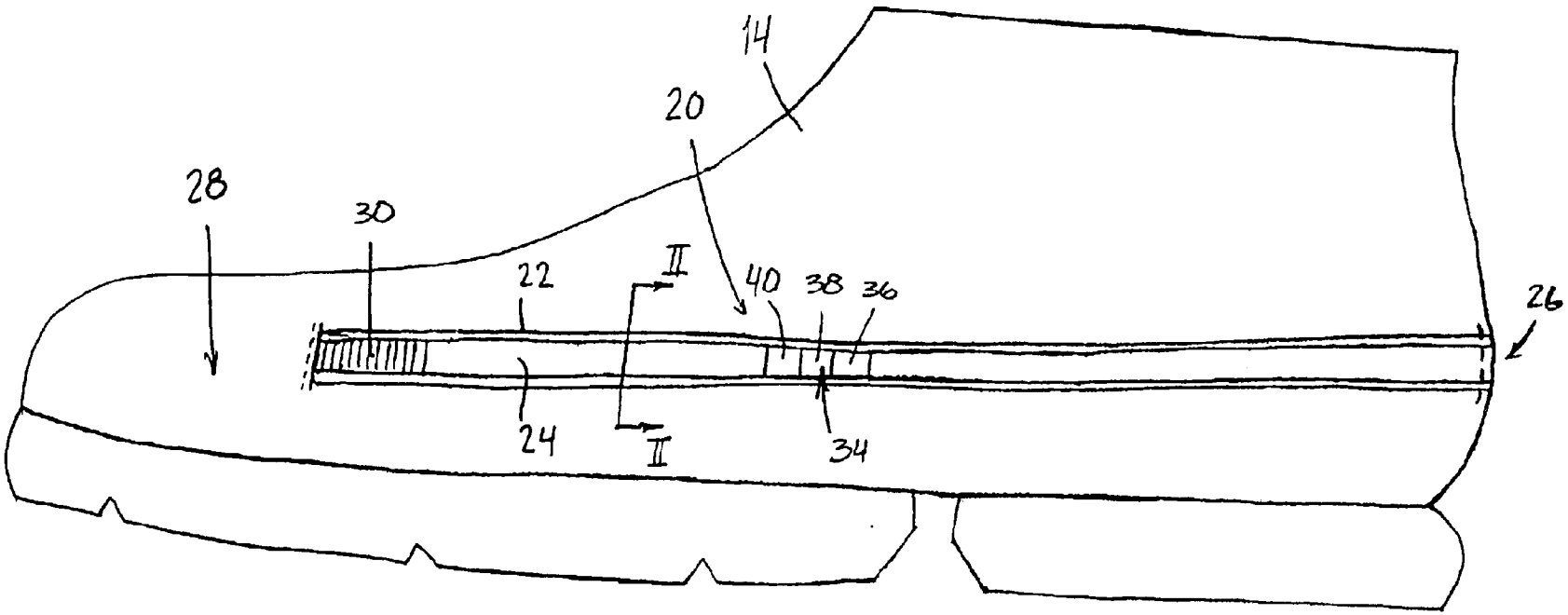
FIG. 1 is a side view of a shoe showing including a sectional view of a growth indicator according to an embodiment of the present invention.
Figure 2:
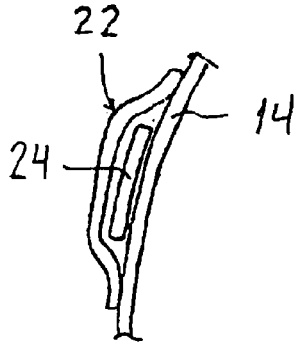
FIG. 2 is a sectional view of a portion of the shoe and growth indicator through line II—II in FIG. 1.

FIGS. 1 and 2 show an expandable shoe having an expandable shoe upper 14 including at least an expandable section made from neoprene, elastic or any other expandable material. An example of a shoe having an expandable upper is disclosed in U.S. Pat. No. 6,374,515, the entire contents of which are expressly incorporated herein by reference. The expandability of the shoe allows for swelling of a foot or allows the shoe to comfortably fit a growing child as the child's foot size increases. To monitor the growth of the foot, the present invention includes a growth indicator 20 which indicates the degree of expansion of the shoe upper along a length of the shoe.

The growth indicator 20 includes a pocket 22 which is stitched on the outside of the shoe upper. The pocket stretches with the shoe upper as the shoe expands. Accordingly, the pocket must be made of a material having a similar elasticity as the upper 14, and is preferably made of the same material as the upper 14. An indicator strip 24 made of a non-stretchable material such as, for example, leather or plastic, is slipped into the pocket and attached to the back heel portion 26 of the shoe and the forepart 28 proximate the ball of a wearer's foot. A piece of elastic material 30 is connected between the front end of the indicator strip 24 and the shoe upper 14. As the shoe upper 14 expands along the length of the shoe, the indicator strip 24 remains in a fixed position relative to the heel portion and the elastic material piece 30 expands.

The indicator strip 24 includes an indicator section 34 having various colors to indicate growth. In the example shown, the indicator section 34 includes three bands of colors 36, 38, 40 which may for example be green, yellow and red (green indicating the non-expandable state, and red indicating the fully expanded state). However, any number of bands and any color scheme may be used to show the degree of expansion. For example, the indicator section may include only one band which indicates a fully expanded state. Furthermore, the indicator could includes dots or other markings instead of the bands 36, 38, 40.

Figure 3:
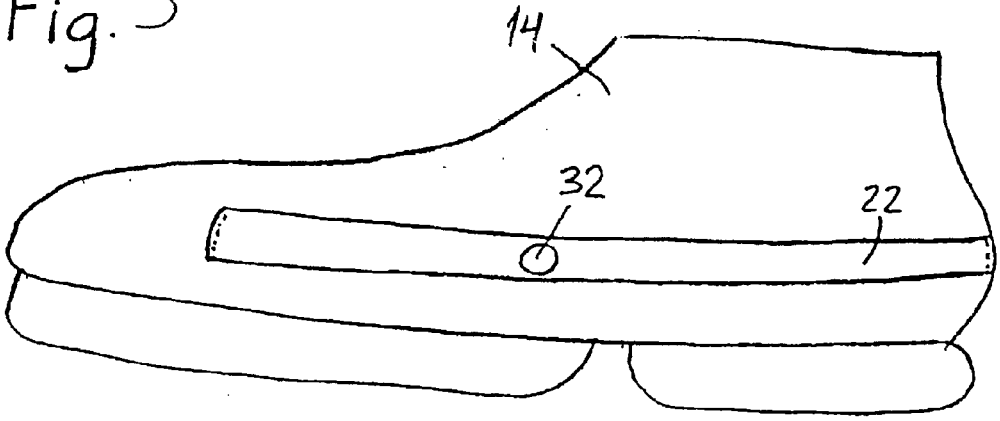
FIG. 3 is a side view of the shoe and growth indicator in FIG. 1.
Figure 4:
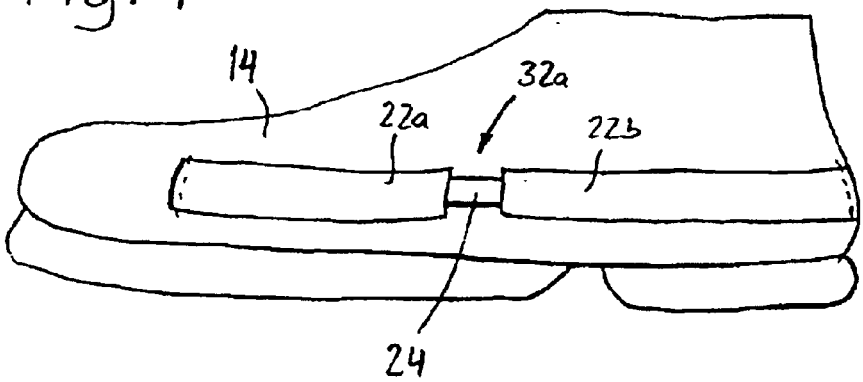
FIG. 4 is a side view of a further embodiment of the shoe and growth indicator of FIG. 1.

As shown in FIG. 3, a window 32 is arranged on the pocket 22 which allows a portion of the indicator section 34 to be viewed therethrough. As the shoe upper 14 expands, the pocket 22 connected to the shoe upper 14 also expands. As the pocket expands 22, the window 32 moves relative to the indicator section 34 so that the band 36, 38, 40 that is viewable through the window indicates how far the shoe has been expanded. In an alternative embodiment shown in FIG. 4, the pocket may comprise two pocket pieces 22*a*, 22*b*. In this embodiment, a window 32*a* through which the indicator section 34 may be viewed is formed by the space between the two pocket pieces 22*a*, 22*b*.

Figure 14:
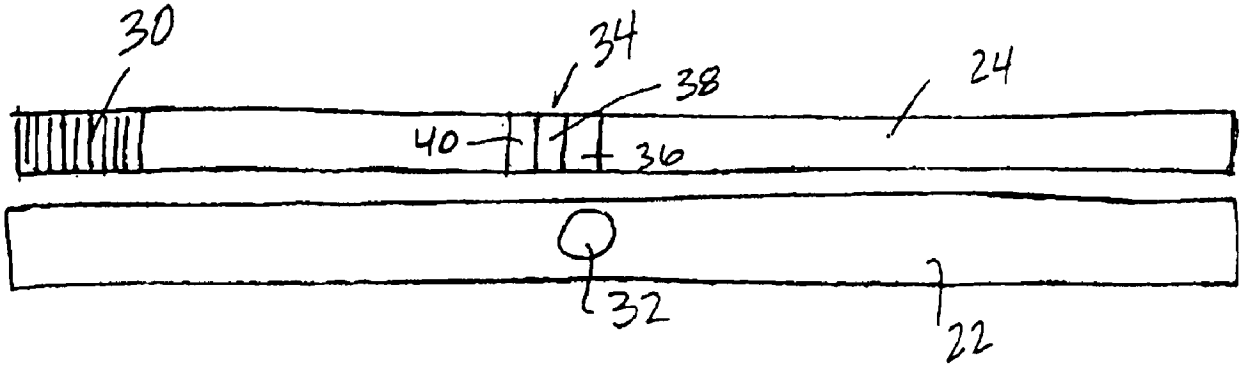
FIG. 14 shows an indicating part and pocket of the growth indicator in an unexpanded state.
Figure 15:
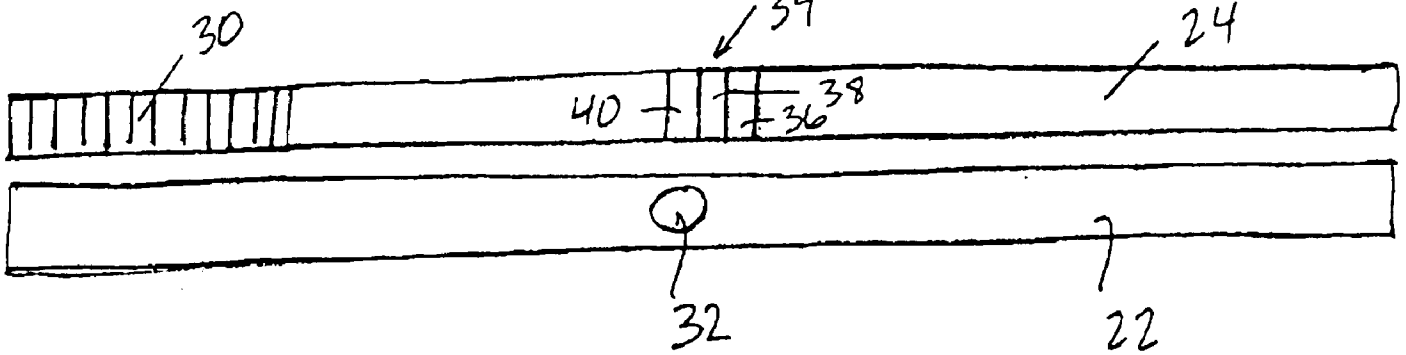
FIG. 15 shows an indicating part and pocket of the growth indicator in an expanded state.

FIGS. 14 and 15 illustrate the relative movements of the pocket 22 and the indicator strip during expansion. FIG. 14 shows the indicator strip 24 and pocket 22 in the unexpanded state. In that position the window 32 is aligned with band 36. FIG. 15, shows the indicator strip 24 and the pocket 22 in the fully expanded state. In that position, the entire pocket 22 stretches with the shoe upper but indicator strip 24 does not. Only the elastic piece 30 connected to the indicator strip stretches. Accordingly, as the pocket 22 stretches, the window moves relative to the indicator section. In FIG. 15, the window 32 is aligned with the band 40 indicating the fully expanded state.

Figure 5:
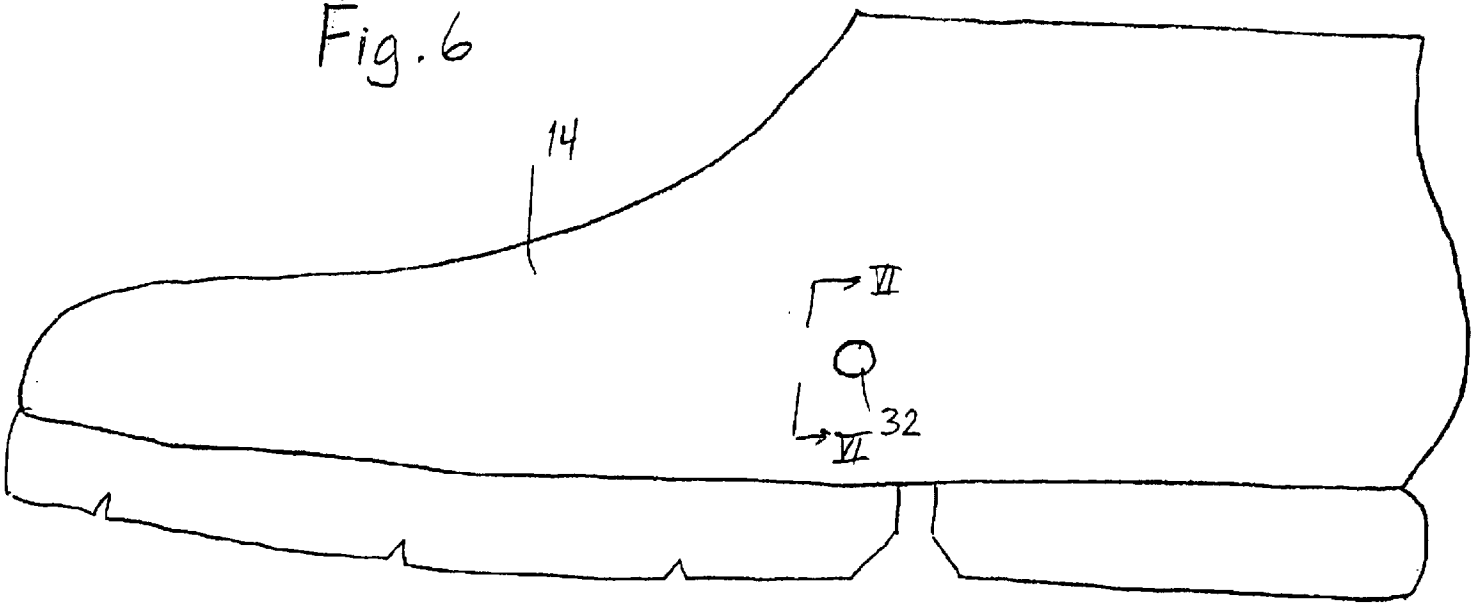
FIG. 5 is a side view of yet another embodiment of the shoe and growth indicator of FIG. 1.
Figure 6:
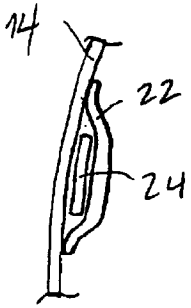
FIG. 6 is a sectional view of a portion of the shoe and growth indicator in FIG. 5 along line VI—VI.

In FIGS. 5 and 6, the pocket 22 is stitched on the inside of the shoe upper 14. In this embodiment, the shoe upper 14 includes the window 32. As in the embodiments shown in FIGS. 1–4, the window 32 in FIGS. 5 and 6 moves relative to the indicator strip 24 during expansion of the shoe upper to indicate the extent of expansion. The section of the shoe upper 14 covering the indicator strip 24 would stretch similarly to the stretching of the pocket 22 depicted in FIGS. 14 and 15.

In any of the embodiments shown in FIGS. 1–6, the elastic material 30 of the indicator strip 24 could alternatively be located at the rear end of the indicator strip 24. In that alternative implementation, the indicating strip would remain stationary relative to the attachment at the front portion thereof. The elastic material could also be connected at an intermediate location anywhere between the indicator section 34 and one of the two ends of the indicator strip 24.

Figure 7:
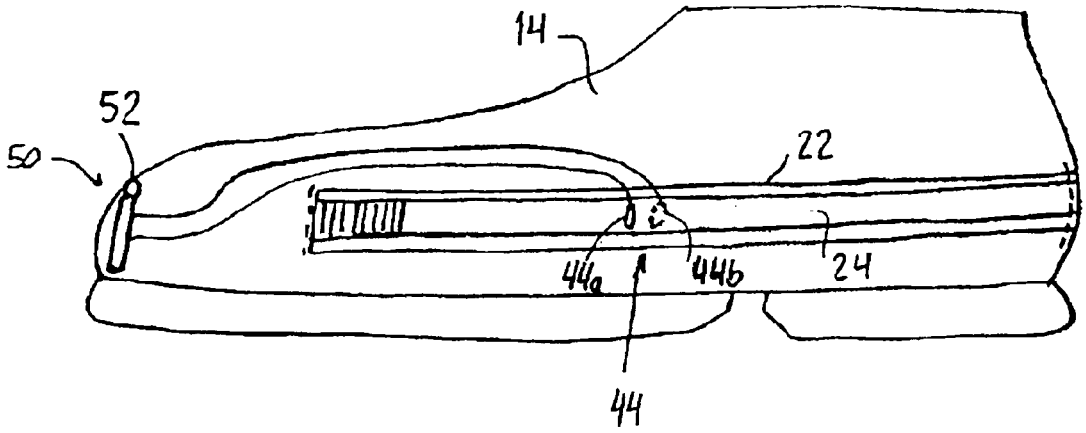
FIG. 7 is a side sectional view of a shoe and growth indicator having a sensor.

Instead of a window 32 and indicator section 34, another embodiment of a growth indicator 50 may include a sensor 44 to indicate when a wearer's foot is too big for the shoe. FIG. 7 shows an embodiment where the sensor 44 comprises a switch having an electric contact 44*a* arranged on the indicator strip 24 and a contact 44*b* arranged on the pocket 22 or shoe upper 14. Contacts 44*a*, 44*b* are arranged such that the relative movement of shoe upper 14 and pocket 22 relative to the indicator strip 24 causes the contacts 44*a*, 44*b* to become electrically connected when the shoe reaches the fully expanded state. When the contacts 44*a*, 44*b* become electrically connected, the indicator 50 changes its output state to indicate that the wearer has outgrown the shoe. The indicator 50 may, for example, comprise an light emitting diode 52 or some other electrically actuated indicating device such as, for example, a buzzer or a relay.

Further contacts could be used to activate different outputs, i.e., different colored LEDs. For example, a first set of contacts could be designed to connect when the shoe is at its smallest size, a second set of contacts could be designed to connect when the shoe is expanded to a middle size and a third set of contacts could be designed to connect when the shoe is fully expanded to the largest possible size. The different colored lights could be connected to each set of contacts to indicate the various stages of expansion of the shoe.

Figure 8:
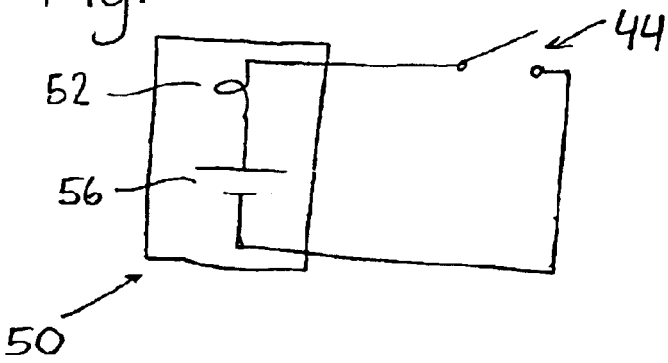
FIG. 8 is a schematic diagram showing a circuit including the sensor of FIG. 7.

FIG. 8 is a simple circuit showing that the indicator 50 includes a power source 56 connected in series with the switch 44 and the indicating device 52. The power source 56 may comprise a battery located at any convenient location in the shoe such as the sole.

Figure 9:
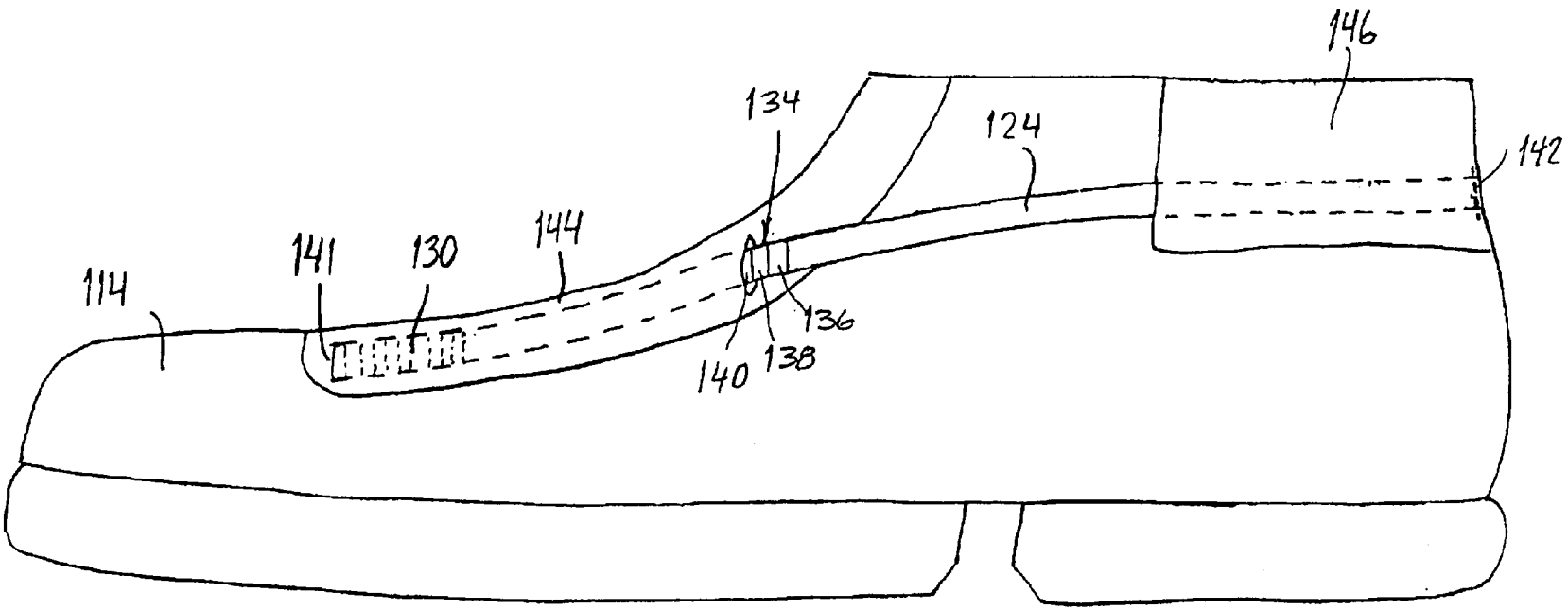
FIG. 9 is a side view of a shoe with another embodiment of the growth indicator.

In FIG. 9, an indicator strip 124 has a front portion 141 inserted in a first pocket 144 and a rear part 142 stitched or fixed in any other known manner proximate the heel area of a shoe having an expandable upper 114. An indicator section 134 is arranged on the indicator strip 124 in the area at which the color band is inserted in the first pocket, which acts as a marker. The band 136, 138, 140 closest to the first pocket 144 indicates the degree of expansion of the shoe. In FIG. 9, the band 140 is shown closest to the pocket thereby indicating that the shoe is near to the fully expanded state. If the shoe was in the unexpanded states, only the band 136 or no band would be visible.

A second pocket 146 may be attached to the shoe upper 114 for aesthetic purposes. However, the second pocket is not required and may be eliminated such that the rear end 142 of the indicator strip 124 is directly fixed to the heel area of the shoe upper.

Figure 10:
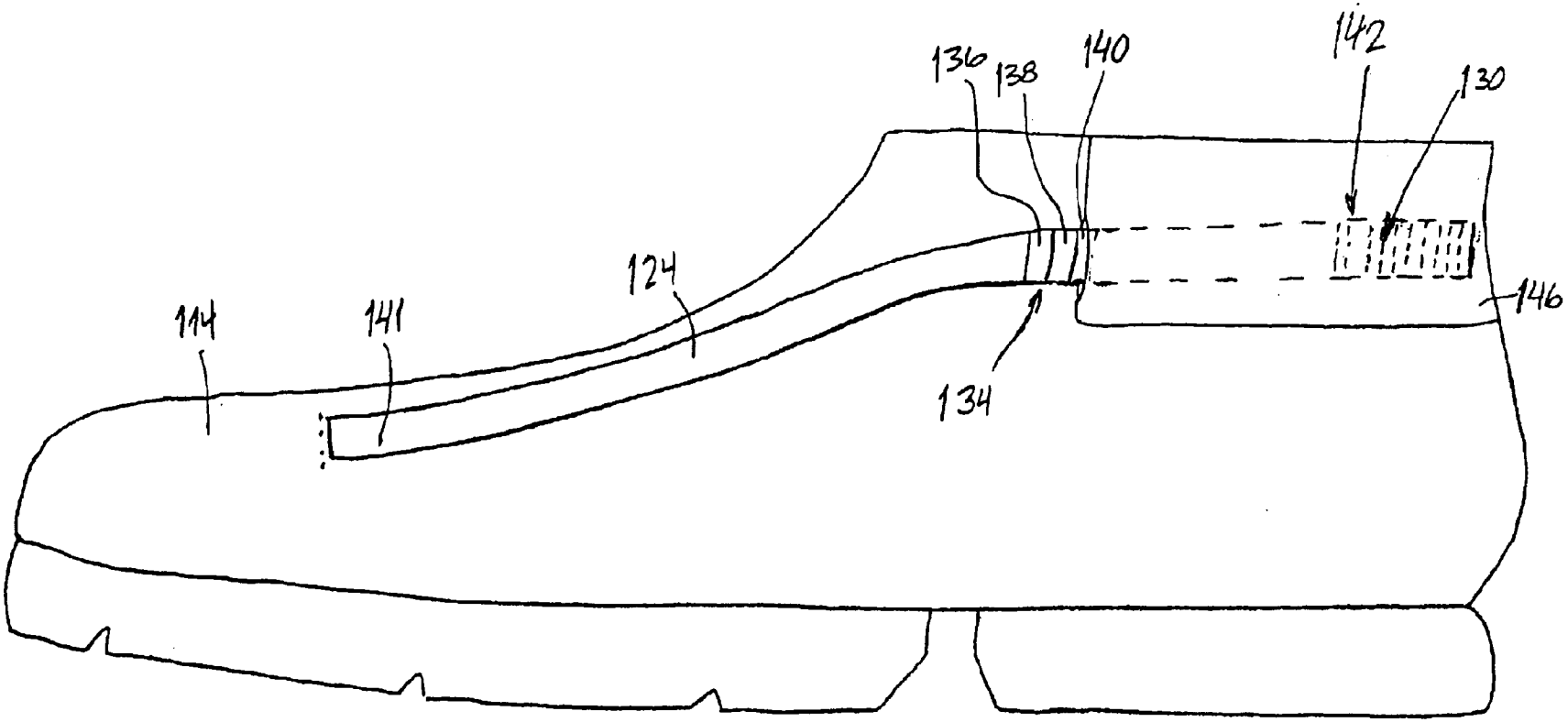
FIG. 10 is a side view of a shoe with a variation of the growth indicator of FIG. 9.

Instead of fixing the rear end 142 of the indicator strip 124 to the heel, the front 141 of the indicator strip 124 may be fixedly attached, i.e., stitched, to the shoe upper 114 as shown in FIG. 10. In this embodiment the color bands 136, 138, 140 are arranged proximate the second pocket 146 to indicate the degree of expansion. In this alternative embodiment, the first pocket may optionally be eliminated such that the front part of the indicator strip 124 is connected directly to the shoe upper.

In the embodiments of FIGS. 9–10, the indicator strip 124 may include an elastic material section 130 connected to one end thereof. In FIG. 9, the elastic material section 130 is connected between the front portion 141 and the indicator section 134 of the indicator strip 124 and in FIG. 10, the elastic section 130 is connected between the rear portion 142 and the indicator section 134 of the indicator strip 124. In each of the embodiments of FIGS. 1–10, the elastic strip 30, 130 may be omitted. In that case, the indicator strip 24, 124 merely slides out of one of the pockets 22, 143, 144 upon expansion of the shoe and slides back into the respective pocket upon contraction of the shoe back to its original size, i.e., when a foot is removed from the shoe.

Figure 11:
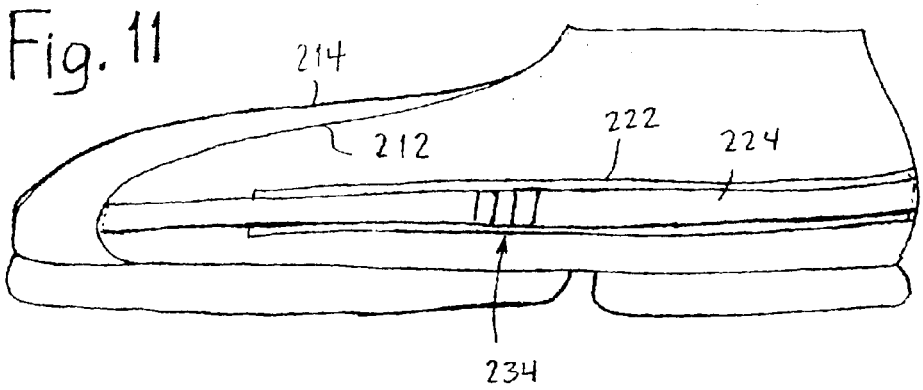
FIG. 11 is a side sectional view of a shoe having an expandable liner and a growth indicator.

FIG. 11 shows an embodiment of a shoe 210 including a shoe upper 214 and an expandable shoe liner 212 made from neoprene, elastic or some other suitably expandable material. The liner 212 is designed to expand as the foot grows, thereby allowing a child to wear the shoe 210 while the child's foot grows through a range of foot sizes. A shoe having a liner is disclosed in U.S. Pat. No. 6,279,251, the entire contents of which are expressly incorporated herein by reference.

An indicator strip 224 is connected between a heel area of the shoe 210 and the front of the shoe liner 212. In this embodiment, the indicator strip 224 may comprise a stretchable material or may be connected to the heel portion of the shoe by an elastic piece. When a wearer's foot is inserted, the liner 212 expands and the indicator strip 224 is pulled forward with the front of the liner. When the wearer removes his foot, the indicator strip 224 moves back to its original position.

The indicator strip 224 may include an indicator section 234 such as the indicator section 34 disclosed above. The indicator section 234 may be viewable through a transparent window in the shoe upper or a pocket as shown in FIGS. 1–6. Since the liner 212 is arranged on the interior of the shoe upper 214, a pocket in which the strip is received may be arranged on the inside of the shoe upper. However, it is also possible to route the indicator strip 224 through an opening in the shoe upper through a pocket arranged on the outer side of the shoe upper. The indicator strip 224 may alternatively include a sensor as disclosed in FIGS. 7–8.

Figure 12:
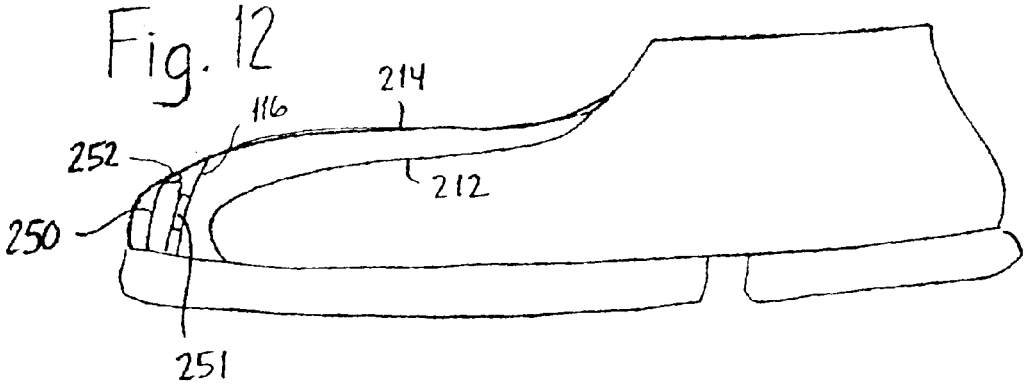
FIG. 12 is a side sectional view of a shoe having an expandable liner and a pressure sensing growth indicator.

In an alternative embodiment shown in FIG. 12, an indicator 250 includes a pressure sensor 251 arranged in front of the expandable lining 212 in the toe area of the shoe. When the wearer's foot grows too big for the shoe, the toes press against the pressure sensor 251. The indicator 250 may be the same as the indicator 50 shown in FIGS. 7–8. An LED 252 illuminates or some other indication occurs when the pressure switch 251 is activated, thereby indicating that the child wearer has outgrown the shoes. An optional barrier material 116 made from cloth, leather, canvas, or any other material may be arranged between the liner 212 and the sensor 251.

Moreover, the sensor and indicator of FIG. 12 may also be arranged in a conventional shoe which does not have an expandable liner. In either embodiment, the light component indicates when the wearer's feet have grown too large for the shoe.

Figure 13:
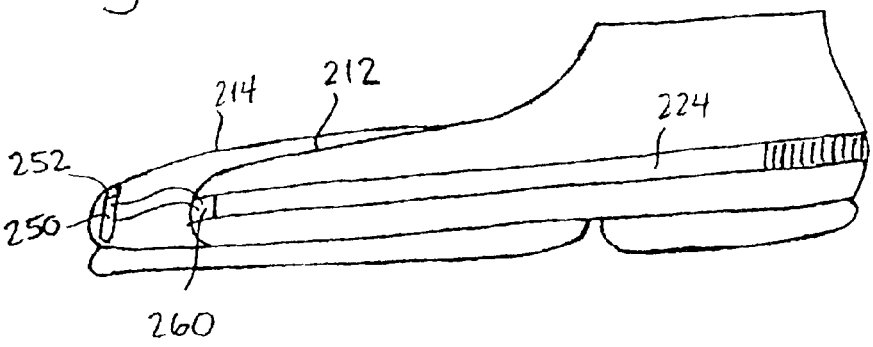
FIG. 13 is a partial sectional view of a shoe having an expandable liner and a tension sensing growth indicator.

Instead of the switch 44 with contacts 44*a*, 44*b*, a tension switch 260 may be connected to the indicator strip 224 as shown in FIG. 13. When the strip 34 is pulled hard enough to indicate a fully stretched shoe, the tension switch is activated to cause the indicator 252 to indicate that the shoe is outgrown. The tension switch 260 may also be implemented in the embodiment of FIG. 7 instead of the sensor 44.

The contacts 44*a*, 44*b* shown in FIG. 7 could be arranged on any two parts of the shoe that move relative to each other in response to the size of the wearer's foot. For example, the contacts 44*a*, 44*b* could be arranged on the shoe upper 214 and the liner 212 in the shoe of FIG. 12 such that when the liner 14 reaches its fully stretched state, the contacts 44*a*, 44*b* connect and the indication indicates a fully stretched state.

In addition, the indicators 52, 252 do not have to be located at the front of the shoe and may be located at any location on the shoe. Furthermore, the indicators 52, 252 do not have to be located on the indicator circuits 5, 250 as shown in the FIGS. 7 and 12. Rather, the indicators 52, 252 may be located remote from the indicator circuits 50, 250 such that the circuits may be arranged at a least intrusive location such as in the sole of the shoe.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A shoe, comprising:

an elastically expandable shoe upper defining a heel portion and a toe portion and having at least an elastically expandable portion, said shoe upper being expandable for receiving a wearer's foot within a range of foot sizes including a minimum foot size and a maximum foot size; and a growth indicator having an indication comprising first and second indicator parts arranged on said shoe upper, said first indicator part having a first end connected to said shoe upper proximate one of the heel portion and the toe portion of said shoe upper and a second end extending toward the other of the heel portion and the toe portion, wherein said second indicator part is movable relative to said first indicator part in response to an expansion of said shoe upper, said growth indicator further including means for changing a state of said indication when the degree of expansion of said shoe upper corresponds to the maximum foot size.

2. The shoe of claim 1, wherein said indication comprises a marking arranged on said first indicator part that is viewable only when said second indicator part is moved to a relative position corresponding to a degree of expansion of said shoe upper for accommodating the maximum foot size.

3. The shoe of claim 2, wherein said second indicator part covers at least a portion of said first indicator part.

4. The shoe of claim 3, wherein said second indicator part comprises a pocket attached to said shoe upper, at least a portion of said first indicator part being slidably received in said pocket such that said at least a portion of said first indicator part slides in said pocket during an expansion of said shoe upper.

5. The shoe of claim 3, wherein said second indicator part comprises a portion of said shoe upper.

6. The shoe of claim 5, further comprising a pocket attached to said shoe upper, at least a portion of said first indicator part being slidably received in said pocket such that said at least a portion of said first indicator part slides in said pocket during an expansion of said shoe upper.

7. The shoe of claim 3, wherein said second indicator part comprises an opening through which said marking is viewable only when said second indicator part is moved to a relative position corresponding to a degree of expansion of said shoe upper for accommodating the maximum foot size.

8. The shoe of claim 1, wherein said indication comprises plural markings arranged on said first indicator part for indicating various sub-ranges of foot sizes in the range of foot sizes such that each of said plural markings corresponds to a different one of the sub-ranges of foot sizes.

9. The shoe of claim 8, wherein each of said plural markings is viewable only when said second indicator part is moved to a position corresponding to a degree of expansion of said shoe upper for accommodating a foot size at least as large as the foot size in the respective sub-range of foot sizes of said each of said plural markings.

10. The shoe of claim 9, wherein said second indicator part covers at least a portion of said first indicator part.

11. The shoe of claim 10, wherein said second indicator part comprises a pocket attached to said shoe upper, at least a portion of said first indicator part being slidably received in said pocket such that said at least a portion of said first indicator part slides in said pocket during an expansion of said shoe upper.

12. The shoe of claim 10, wherein said second indicator part comprises a portion of said shoe upper.

13. The shoe of claim 12, further comprising a pocket attached to said shoe upper, at least a portion of said first indicator part being slidably received in said pocket such that said at least a portion of said first indicator part slides in said pocket during an expansion of said shoe upper.

14. The shoe of claim 10, wherein said second indicator part comprises an opening through which each of said plural markings is viewable only when said second indicator part is moved to a relative position corresponding to a degree of expansion of said shoe upper for accommodating a foot size in the respective sub-range of foot sizes of said each of said plural markings.

15. The shoe of claim 1, wherein said growth indicator further comprises a sensor for sensing when the size of a wearer's foot received in said shoe upper is at least as large as the maximum foot size and said means for changing a state is responsive to said sensor.

16. The shoe of claim 15, wherein said sensor comprises an electrical contact arranged on each of said first indicator part and said second indicator part.

17. The shoe of claim 16, wherein said growth indicator further comprises an electric device, wherein said means for changing a state of said indication comprises means for changing a state of said electric device in response to said sensor.

18. The shoe of claim 17, wherein said electric device comprises a light and said means for changing a state comprises means for illuminating said light.

19. The shoe of claim 15, wherein said sensor comprises a tension sensor connected at said first end of said first indicator part.

20. The shoe of claim 19, wherein said growth indicator further comprises an electric device, wherein said means for changing a state of said indication comprises means for changing a state of said electric device in response to said sensor.

21. The shoe of claim 20, wherein said electric device comprises a light and said means for changing a state comprises means for illuminating said light.

22. The shoe of claim 1, further comprising an elastic portion connected between said shoe upper and said second end of said first indicator part.

23. The shoe of claim 22, wherein said first end of said first indicator part is connected to said shoe upper proximate said heel portion.

24. The shoe of claim 22, wherein said first end of said first indicator part is connected to said shoe upper proximate said toe portion.

25. A shoe comprising:

a shoe upper defining a heel portion and a toe portion for receiving a wearer's foot within a range of foot sizes including a minimum foot size and a maximum foot size;

a growth indicator having an indication connected to said shoe upper and including means for changing a state of said indication when a size of the wearer's foot received in said shoe upper is at least as large as the maximum foot size, said growth indicator comprising first and second indicator parts arranged on said shoe upper, said first indicator part having a first end connected to said shoe upper proximate one of the heel portion and the toe portion of said shoe upper and a second end extending toward the other of the heel portion and the toe portion, wherein said second indicator part is movable relative to said first indicator part in response to an expansion of said shoe upper; and an elastic portion connected between said shoe upper and said second end of said first indicator part.

26. The shoe of claim 25, wherein said first end of said first indicator part is connected to said shoe upper proximate said heel portion.

27. The shoe of claim 25, wherein said first end of said first indicator part is connected to said shoe upper proximate said toe portion.

* * * * *

UNITED STATES PATENT AND TRADEMARK OFFICE

CERTIFICATE OF CORRECTION

PATENT NO. : 6,796,057 B2
APPLICATION NO. : 10/164527
DATED : September 28, 2004
INVENTOR(S) : Howard F. Davis It is certified that error appears in the above-identified patent and that said Letters Patent is hereby corrected as shown below:

On Title Page, Item 60 col. 1 should read,
Please replace the Related U.S. Application Data with the following:

Related U.S. Application Data
(60) Provisional application No. 60/296,643, filed on Jun. 7, 2001, and provisional application No. 60/323,154, filed on Sep. 18, 2001

Please replace paragraph [001] with the following:

-- The present application claims the benefit of the filing date of co-pending provisional application Nos. 60/296,643, filed on June 7, 2001, and 60/323,154, filed on September 18, 2001, the entire contents of which are incorporated herein by reference. --

Signed and Sealed this

First Day of August, 2006

JON W. DUDAS
*Director of the United States Patent and Trademark Office*